United States Patent [19]

Kingston et al.

[11] Patent Number: 4,510,238

[45] Date of Patent: Apr. 9, 1985

[54] PHOTOGRAPHIC MATERIAL AND A PROCESS FOR ITS MANUFACTURE

[75] Inventors: Samuel B. Kingston, Doddinghurst; Graham Evans, Galleywood, both of England

[73] Assignees: Ciba Geigy AG, Basel, Switzerland; Ciba Geigy AG, Basle, Switzerland

[21] Appl. No.: 471,556

[22] Filed: Mar. 2, 1983

[30] Foreign Application Priority Data

Mar. 11, 1982 [GB] United Kingdom ..... 8207063

[51] Int. Cl.[3] ..... G03C 1/72

[52] U.S. Cl. ..... 430/627; 430/628; 430/631

[58] Field of Search ..... 430/627, 628, 631

[56] References Cited

U.S. PATENT DOCUMENTS

| | | | |
|---|---|---|---|
| 3,632,342 | 1/1972 | Salesin et al. | 430/627 |
| 3,700,456 | 10/1972 | Smith | 430/627 |
| 3,772,032 | 11/1973 | Pearson et al. | 430/628 |
| 4,245,036 | 1/1981 | De Winter et al. | 430/627 |

*Primary Examiner*—Jack P. Brammer

*Attorney, Agent, or Firm*—Joseph G. Kolodny; Joseph G. Kolodny

[57] ABSTRACT

Photographic material containing on a support at least one silver halide emulsion layer which contains as binders both gelatin and a polymer latex, wherein the particle size is less than 0.05 μm, and which is obtained by emulsion polymerizing a monomer or monomer mixture which consists of an alkyl acrylate or an alkyl methacrylate or a monomer mixture comprising both an alkyl acrylate and an alkyl methacrylate or a mixture comprising an alkyl acrylate and/or an alkyl methacrylate together with up to 5% by weight of an ethylenically unsaturated copolymerizable acid and/or up to 30% by weight of other ethylenically unsaturated comonomers in the presence of at least 12% by weight of the monomers present of an anionic surfactant at a temperature of from 15° C. to 90° C. by use of a redox initiator system which is present to the extent of from 0.1% to 3% by weight of the monomers present.

The latexes are of use to partially replace gelatin in photographic materials. These latex/gelatin binders are suitable for highspeed coating and drying processes and confer to the photographic materials an increased dimensional stability.

15 Claims, No Drawings

PHOTOGRAPHIC MATERIAL AND A PROCESS FOR ITS MANUFACTURE

This invention relates to photographic silver halide material wherein the binder for the silver halide crystals comprises both gelatin and a polymer latex, the particles of which have an average particle size of less than 0.05 μm, and to a process for the manufacture of this material.

Gelatin has long been established as a binder for use in photographic films because of its good dispersion and protective colloidal properties. However, gelatin-containing photographic material suffer from the disadvantage of being dimensionally unstable under certain temperature and humidity conditions and also tend to curl when dried. Furthermore, photographic emulsions containing only gelatin as binder are unsuitable for the high-speed coating and drying processes. Efforts have therefore been made to improve this deficiency by replacing gelatin partially or completely by other natural or synthetic materials.

Thus for example certain vinyl polymers have been used as described in U.S. Pat. Nos. 3,062,674 and 3,142,568. Latexes based on alkyl acrylates have also been described in DE Nos. 1,622,925 and 1,900,783. However, the latexes produced by these methods produce turbidity in the wet film.

In a gelatin layer a polymer dispersion is present as a hetero-dispersed phase. This heterodispersity imparts a milky appearance to the layer in the wet state. The transparency of a layer with heterodispersed particles depends on the difference in refractive index of the binding agent and of the dispersed phase. In a layer consisting of a hydrophilic binding agent and a hydrophobic dispersed phase, this phenomenon shows a twofold aspect: the binding agent has two refractive indices according to whether it is in a dry state (dry gelatin: $n=1.500$) or whether it is in a wet state (wet gelatin: $n=1.380$). However, the refractive index of the hydrophobic polymer remains unchanged in the dry and wet layer ($n=1.507$).

In dry layers, the refractive indices of the gelatin and polymer layers lie very close to each other and thus very clear layers can be obtained. In wet state, however, the refractive index of the moist gelatin layer decreases to about 1.38. Since the refractive index of the hydrophobic latex particles remains unchanged the large number of interfaces are created between phases with different refractive indices, which results in a pronounced dullness of the layer. This is greatly disadvantageous during processing of the photographic material because it tends to obscure the state of development of the material during the development stage and tends to obscure unfixed silver halide during the fixing step. Thus, faultily developed prints or films and not wholly fixed prints or films can be produced.

If, however, the size of the particles is very much less than the wavelength of light (i.e. less than ca. 0.05 μm), this difference in refractive indices is of no significance and the layer remains essentially transparent whether it be in the wet state or the dry state.

Therefore, according to the present invention there is provided a photographic material which comprises on a support at least one aqueous gelatino silver halide emulsion layer, the binder of which comprises both gelatin and a polymer latex which has been prepared by emulsion polymerising:

(a) an alkyl acrylate or an alkyl methacrylate or
(b) a monomer mixture comprising both an alkyl acrylate and an alkyl methacrylate or
(c) a monomer mixture comprising an alkyl acrylate and/or an alkyl methacrylate together with up to 5% by weight of an ethylenically unsaturated copolymerisable acid and/or up to 30% by weight of other ethylenically unsaturated comonomers in the presence of at least 12% by weight of the monomers present of an anionic surfactant at a temperature of from 15° to 90° C. by use of a redox initiator system which is present to the extent of from 0.1 to 3% by weight of the monomers present, the average particle size of the polymer latex particles being less than 0.05 μm.

Another object of the invention is the process for the manufacture of this material, which comprises coating onto a support at least one aqueous gelatino silver halide emulsion layer, the binder of which comprises both gelatin and a polymer latex wherein the particle size is less than 0.05 μm, the polymer latex being prepared by emulsion polymerising:

(a) an acrylate or an alkyl methacrylate or
(b) a monomer mixture comprising both an alkyl acrylate and an alkyl methacrylate or
(c) a monomer mixture comprising an alkyl acrylate and/or an alkyl methacrylate together with up to 5% by weight of an ethylenically unsaturated copolymerisable acid and/or up to 30% by weight of other ethylenically unsaturated comonomers in the presence of at least 12% by weight of the monomers present of an anionic surfactant at a temperature of from 15° to 90° C. by use of a redox initiator system which is present to the extent of from 0.1 to 3% by weigth of the monomer present, and drying the coated layer.

Preferably the glass transition temperature (Tg) of the polymer of the polymer latex is less than about 20° C. because polymers exhibiting such glass transition temperatures have been found to be most suitable to be included in the photographic layers of the material according to the present invention.

The photographic material according to the present invention exhibits substantially no milkiness when processed in aqueous processing baths and in the dry state the binder layers are transparent. Furthermore, the resultant photographic material exhibits the usual advantages claimed for photographic materials wherein part of the gelatin of the silver halide emulsion layer or layers has been replaced by a polymer latex, that is to say the material shows greater dimensional stability, especially when the photographic material is machine processed after exposure, and the amount of water which is absorbed during processing and which must be removed by drying is decreased and the dried material has decreased curl.

In order to obtain enhanced dimensional stability namely a reduction in the curl of the photographic material, when it is to be machine processed, it is preferred that the copolymer present in the aqueous gelatin silver halide emulsion, also comprises about 1% by weight of the total monomer content of a cross-linking agent. Thus the latex which is present in the aqueous coating mixture is to a certain extent cross-linked. If much more than 1% by weight of cross-linking agent has been used in the preparation of the copolymer it tends to be irreversibly gelled on polymerisation.

Any cross-linking agent which can cross-link acrylates or methacrylates can be used. Most of these cross-linking agents contain two ethylenically unsaturated double bonds and exemplary of such compounds are dimethyl acrylate esters such as ethylene glycol dimethacrylate. Alternatively, a monomer may be used which contains reactive groups which cross-link to the gelatin, e.g. epoxide groups.

It is preferred that the latex copolymer comprises from 20 to 60% by weight of the binder material of the final dried silver halide emulsion layer. Most preferably the polymer comprises about 30% by weight of the binder material of the final dried silver halide emulsion layer. That is to say 30% by weight of gelatin has been replaced by the synthetic polymer.

In order to achieve maximum dimensional stability of the photographic material latex copolymers are often present in other non-silver halide layers of the photographic material, for example filter layers, antihalation under-layers, protective layers, barrier layers and thus to reduce milkiness during processing of photographic material containing such layers, it is preferred that the latex copolymer used is that prepared by the method of the present invention. Further, these latex copolymers find use in image receiving layers in photographic diffusion transfer processes.

The photographic materials produced by the process of the present invention include both film and paper products and thus the support may be paper, polyethylene laminated paper, polyethylene terephthalate, cellulose triacetate and cellulose acetate-butyrate film base and other film bases of use as supports for photographic materials.

In the emulsion polymerisation process for preparing the polymer latex, the preferred temperature range for the polymerisation reaction is from 60° to 70° C.

The polymer latex has an average particle size of less than 0.05 Å as determined by hydrodynamic chromatography. This technique is described for example by H. Small in J. Colloid and Interface Science, Vol. 48, 147 (1974) and by H. Small, F. L. Saunders and J. Bale in Advances in Colloid and Interface Science, Vol. 6, 237 (1976).

It is an essential feature of the process that the total amount of surfactant used is at least 12% by weight of the monomers present. If less is used, as in the process described in GB No. 1333663, the average particle size of the copolymers in the latex is significantly greater (cf. below Example 1). The preferred amount of total surfactant to be present during the polymerisation reaction is from 15 to 20% by weight of the monomers present.

Particularly suitable anionic surfactants for use in the process are sulphosuccinate compounds, for example disodium ethoxylated nonyl phenol half ester of sulphosuccinic acid, tetrasodium N-(1,2-dicarboxyethyl)-N-octadecylsulphosuccinamate, or a mixture of either of these or similar surfactants with other conventional anionic surfactants.

Other useful anionic surfactants are sulphated or sulphonated polyethylene oxide compounds. Certain surfactants, although capable of producing latexes with a very small particle size, may, however, also have deleterious photographic effects.

Suitable acrylate and methacrylate monomers for use in the process of the present invention are methyl acrylate, methyl methacrylate, butyl methacrylate, 2-ethylhexyl acrylate, but most preferably butyl acrylate.

Where the monomer mixture contains other ethylenically unsaturated comonomers, then those monomers may be selected from for example styrene, acrylonitrile, vinylidene chloride or vinyl acetate, hydroxyethyl acrylate, hydroxyethyl methacrylate, hydroxypropyl methacrylate, and butyl acrylate optionally with a minor amount of methyl methacrylate. It is however an important feature of the process, that if comonomers such as acrylic acid, methacrylic acid or other polymerisable acids are used, their proportion of the total monomer content should not exceed 5%, otherwise a substantial increase in particle size is observed.

The preferred redox initiator system for use in the process of the present invention is the sodium or potassium persulphate/sodium metabisulphite system. Conveniently, the monomers and the metabisulphite are emulsified with some of the surfactant, then added dropwise to the reaction vessel which is maintained preferably between 60° and 70° C. and contains persulphate and the remainder of the surfactant.

Optionally, a chain transfer reagent, for example isopropanol, may be present either in the pre-emulsified monomer mixture or present in the reaction vessel initially.

The solids content of the polymer latex can be varied, but most usefully the amount of polymer present in the latex is within the range of 30 to 40% by weight of the total weight of the latex.

The following Examples will serve to illustrate the invention.

EXAMPLE 1

General polymerisation procedure

Water, sodium persulphate and a portion of the surfactant are added to the reaction vessel which is purged with nitrogen, and the temperature raised to 60° C. A pre-emulsified monomer mixture is prepared by mixing monomers, water, sodium metabisulphite and the remainder of the surfactant using a mechanical stirrer. This pre-emulsified mixture is added portionwise to the reaction vessel using a metering pump over the course of approximately one hour. The reaction mixture is maintained under nitrogen atmosphere at approximately 65° C. during the addition. At the end of the addition the mixture is stirred for a further two hours at 65° C. before adding a further portion of persulphate and metabisulphite. The mixture is allowed to cool to room temperature with continued stirring before filtering through muslin and bottling up.

Surfactants of the following formulae are used in this Example:

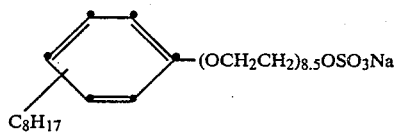

(1)

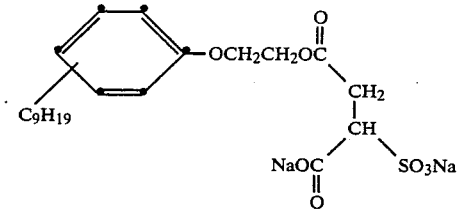

(2)

-continued and

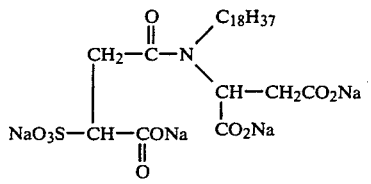

(3)

The following abbreviations are used:

BA=butyl acrylate; HPMA=2-hydroxypropyl methacrylate; BMA=butyl methacrylate; HEMA=hydroxyethyl methacrylate; HEA=hydroxyethyl acrylate; DHPMA=2,3-di-hydroxypropyl methacrylate; MMA=methyl methacrylate; VDC=vinylidene dichloride; SMBS=sodium metabisulphite; SPS=sodium persulphate; PE=pre-emulsified; IP=in pot.

The following copolymer latexes 1 to 14 and 18 were prepared following the general polymerisation procedure as just set forth.

The average particle sizes are determined using hydrodynamic chromatography.

Copolymer Latex 1

PE: BA 235 ml; HPMA 65 ml; surfactant of the formula (2) 75 ml; Water 150 ml; SMBS 0.8 g.

IP: Water 300 ml; surfactant of the formula (3) 75 ml; SPS 1.6 g Average particle size: 0.038 μm.

Copolymer Latex 2

PE: BA 225 ml; MMA 175 ml; HPMA 50 ml; surfactant of the formula (2) 75 ml; SMBS 0.8 g; Water 400 ml.

IP: Water 200 ml; surfactant of the formula (3) 75 ml; SPS 1.6 g; Average particle size: 0.048 μm.

Copolymer Latex 3

PE: BA 117 ml; HPMA 32 ml; surfactant of the formula (2) 50 ml; Water 75 ml; SMBS 0.4 g.

IP: Water 150 ml; surfactant of the formula (2) 50 ml; SPS 0.8 g. Average particle size: 0.033 μm.

Copolymer Latex 4

PE: BA 117 ml; HPMA 32 ml; surfactant of the formula (1) 50 ml; Water 75 ml; SMBS 0.4 g.

IP: Water 150 ml; surfactant of the formula (1) 50 ml; SPS 0.8 g. Average particle size: 0.039 μm.

Copolymer Latex 5

PE: BA 225 ml; styrene 175 ml; HPMA 100 ml; surfactant of the formula (2) 100 ml; Water 335 ml; surfactant of the formula (1) 75 ml; SMBS 1.4 g.

IP: Water 350 ml; surfactant of the formula (2) 150 ml; SPS 2.8 g. Average particle size 0.032 μm.

Copolymer Latex 6

PE: BA 225 ml; MMA 17.5 ml; HPMA 100 ml; surfactant of the formula (2) 90 ml; Solumin FP 85 SD 75 ml; Water 335 ml; SMBS 1.4. g.

IP: Water 350 ml; surfactant of the formula (2) 150 ml; SPS 2.8 g. Average particle size: 0.033 μm.

Copolymer Latex 7

PE: BA 90 ml; BMA 70 ml; HEMA 40 ml; surfactant of the formula (2) 60 ml; Water 100 ml; SMBS 0.6 g.

IP: Water 180 ml; surfactant of the formula (2) 60 ml; SPS 1.2 g. Average particle size: 0.041 μm.

Copolymer Latex 8

PE: BA 140 ml; HPMA 60 ml; surfactant of the formula (2) 60 ml; Water 140 ml; SMBS 0.6 g.

IP: Water 140 ml; surfactant of the formula (2) 60 ml; SPS 1.2 g. Average particle size: 0.039 μm.

Copolymer Latex 9

PE: BA 96 ml; MMA 74 ml; HEMA 33 ml; surfactant of the formula (2) 36 ml; surfactant of the formula (1) 30 ml; SMBS 0.6 g; Water 134 ml.

IP: Water 140 ml; surfactant of the formula (2) 60 ml; SPS 1.2 g. Average particle size: 0.040 μm.

Copolymer Latex 10

PE: BA 110 ml; HPMA 40 ml; Acrylonitrile 50 ml; surfactant of the formula (2) 60 ml; Water 140 ml; SMBS 0.6 g.

IP: Water 140 ml; surfactant of the formula (2) 60 ml; SPS 1.2 g. Averag particle size: 0.031 μm.

Copolymer Latex 11

PE: BA 100 ml; MMA 100 ml; surfactant of the formula (2) 60 ml; Eater 140 ml; SMBS 0.6 g.

IP: Water 140 ml; surfactant of the formula (2) 60 ml; SPS 1.2 g. Average particle size 0.038 μm.

Copolymer Latex 12

PE: BA 75 ml; DHPMA 25 ml; surfactant of the formula (2) 30 ml; Water 170 ml: SMBS 0.3 g.

IP: Water 170 ml; surfactant of the formula (2) 30 ml; SPS 0.6 g. Average particle size: 0.036 μm.

Copolymer Latex 13

PE: BA 100 ml; styrene 100 ml; surfactant of the formula (2) 60 ml; Water 140 ml; SMBS 0.6 g.

IP: Water 140 ml; surfactant of the formula (2) 60 ml; SPS 1.2 g. Average particle size: 0.040 μm.

Copolymer Latex 14

PE: BA 100 ml; styrene 70 ml; glycidyl methacrylate 30 ml; surfactant of the formula (2) 60 ml; Water 140 ml; SMBS 0.6 g.

IP: Water 140 ml; surfactant of the formula (2) 60 ml; SPS 1.2 g. Average particle size: <0.05 μm.

Comparative Copolymer Latex 18

This latex comprises only 3% of surfactant.

PE: BA 235 ml: HPMA 65 ml; surfactant of the formula (2) 17 ml; Water 223 ml; SMBS 0.8 g.

IP: Water 200 ml; surfactant of the formula (2) 10 ml; SPS 1.6 g. Average particle size: 0.092 μm.

EXAMPLE 2

Experimental procedure for the copolymer latexes 15 to 17

Water, sodium persulphate and a portion of the surfactant are added to the reaction vessel which is purged with nitrogen and the temperature held at 29° to 31° C. The system is then seald to prevent escape of monomer and vapour and the monomers are introduced separately into the reaction vessel. The two monomer feeds which also contain the remainder of the surfactant, water and sodium metabisulphite are added proportion wise using a metering pump over the course of two to three hours. At the end of the addition the mixture is stirred for a further 12 hours to achieve maximum conversion.

The mixture is allowed to cool to room temperature with continued stirring before it is filtered through muslin and bottled up.

Copolymer Latex 15

Monomer mixture: VDC 262.5 ml; MMA 33.0 ml.

Emulsifier mixture: Water 500 ml; surfactant of the formula (2) 150 ml; surfactant of the formula (1) 45 ml; SMBS 1.25 g.

IP: Water 25 ml; SPS 25 g. Average particle size: 0.038 μm.

Copolymer Latex 16

Monomer mixture: VDC 281 ml; BA 15 ml.

Emulsifier mixture: Water 500 ml; surfactant of formula (2) 150 ml; surfactant of formula (1) 45 ml; SMBS 1.25 g.

IP: Water 25 ml; SPS 2.5 g. Average particle size 0.037 μm.

Copolymer Latex 17

Monomer mixture: VDC 98.5 ml; Styrene 12.5 ml

Emulsifier mixture: Water 1875 ml; surfactant of the formula (2) 56.5 ml; surfactant of the formula (1) 17 ml; SMBS 0.47 g.

IP: Water 94 ml; surfactant of the formula (2) 56.5 ml; surfactant of the formula (1) 17 ml; SPS 0.94 g. Average particle size 0.038 μm.

Examples 1 and 2 show that all the copolymer latexes prepared by the process of the present invention have an average particle size of less than 0.05 μm. However the comparative copolymer latex 18, the preparation of which comprises less surfactant, has a much larger average particle size.

EXAMPLE 3

Photographic silver emulsions are prepared having the following composition:

| | | |
|---|---|---|
| Emulsion 1. | | |
| silver bromochloride | 20 | mg dm$^2$ |
| gelatin | 66.5 | mg dm$^2$ |
| latex 1 (as prepared in Ex. 1) | 28.5 | mg dm$^2$ |
| Emulsion 2. | | |
| silver bromochloride | 20 | mg dm$^2$ |
| gelatin | 66.5 | mg dm$^2$ |
| latex 18 (comparative latex) | 28.5 | mg dm$^2$ |
| Emulsion 3. | | |
| silver bromochloride | 20 | mg dm$^2$ |
| gelatin | 95 | mg dm$^2$ |

All the emulsions are hardened with a triazine hardener.

All the emulsions are coated on sheets of a baryta coated photographic paper base.

All the sheets of photographic material are imagewise exposed in an enlarger and processed at 60° C. in an open dish photographic developing bath which contains a solution of a paper developer bath based on hydroquinone and metol.

When coated (latex free) emulsion 3 is processed a clear black image slowly appears during the processing in the developing solution. This image is inspected during the developing to ensure it has been developed for the correct length of time.

The material is then fixed in an ammonium thiosulphate fixing solution and washed in running water for 10 minutes. Finally the print is dried in a hot air drier to produce a fully processed and dried print. The curl of the sheet is then measured.

When coated (comparative) emulsion 2 which contains the latex having an average size of 0.092 μm is processed a milky black image slowly appears. This milkiness persists even when the material has been processed for several minutes and clearly is overdeveloped. Thus it is not possible to control the development by visual inspection. A second sheet of the same material is exposed and developed and when the milk black image appears to be correctly developed the sheet is fixed, washed and dried as for coated emulsion 1. On inspection the print is found not to be completely correctly developed and the blackest areas of the image still shows some milkiness.

When coated (inventive) emulsion 1 is processed a clear black image slowly appears. This image is inspected during the course of development and when it appears correctly developed, it is fixed, washed and dried as coated emulsion 3. After drying the image is again inspected and is found to have been correctly developed with no sign of milkiness even in the blackest areas of the image.

The curl figures 1/R (where R is the radius of curvature in cm; higher figures represent great curl) are determined for emulsions 1 to 3:

| | Relative humidity % | | |
|---|---|---|---|
| Coatings | 21 | 51 | 80 |
| Emulsion 1 | 0.09 | 0.103 | 0.03 |
| Emulsion 2 | 0.08 | 0.020 | 0.03 |
| Emulsion 3 | 0.33 | 0.143 | 0.04 |

These results show that the coating which contains no latex curl badly at a low relative humidity, for example when it is received from the hot air drier it is badly curled. However when the coatings contain 30% replacement of the gelatin by a latex there is little curling and when these prints are received from the drier they are substantially flat. Moreover there is little difference in the curl prevention when using the latex of the material according to the present invention than when using the prior art latex. But when using the prior art latex visual inspection of the print material during processing would not be carried out because the latex produced a considerable milkiness in the material when it is wet.

We claim:

1. Photographic material which comprises on a support at least one aqueous gelatino silver halide emulsion layer, the binder of which essentially consists of gelatin and of from 20 to 60% by weight of the binder material of the final dried silver halide emulsion layer of a polymer latex containing particles of a particle size of less than 0.05 microns, the polymer latex being obtained by emulsion polymerising of (a) a monomer selected from the group consisting of an alkyl acrylate or an alkyl methacrylate or (b) a monomer mixture essentially consisting of both an alkyl acrylate and an alkyl methacrylate or (c) a monomer mixture essentially consisting of an alkyl acrylate and/or an alkyl methacrylate together with up to 5% by weight of an ethylenically unsaturated copolymerisable acid and/or up to 30% by weight of other ethylenically unsaturated comonomers in the presence of at least 12% by weight of the monomers present of an anionic surfactant selected from the group consisting of a sulphosuccinate or a sulphated or sulphonated polyethylene oxide compound at a temperature of from 15° to 90° C. by use of a redox initiator system which is present to the extent of from 0.1 to 3% by weight of the monomers present.

2. A material according to claim 1, wherein the latex is partially cross-linked.

3. A material according to claim 1, where the glass transition temperatur of the polymer of the polymer latex is less than about 20° C.

4. A material according to claim 1, wherein the latex copolymer comprises about 30% by weight of the binder material.

5. A process for the manufacture of the photographic material according to claim 1 which comprises coating onto a support at least one aqueous gelatino silver halide emulsion layer, the binder of which essentially consists of both gelatin and of from 20 to 60% by weight of the binder material of the final dried silver halide emulsion layer of a polymer latex wherein the particle size is less than 0.05 microns, the polymer latex being prepared by emulsion polymerising of (a) a monomer selected from the group consisting of an alkyl acrylate or an alkyl methacrylate or
(b) a monomer mixture essentially consisting of both an alkyl acrylate and an alkyl methacrylate or
(c) a monomer mixture essentially consisting of an alkyl acrylate and/or or an alkyl methacrylate together with up to 5% by weight of an ethylenically unsaturated copolymerisable acid and/or up to 30% by weight of other ethylenically unsaturated comonomers in the presence of at least 12% by weight of the monomers present of an anionic surfactant selected from the group consisting of a sulphosuccinate or a sulphated or sulphonated polyethylene oxide compound at a temperature of from 15° to 90° C. by use of a redox initiator system which is present to the extent of from 0.1 to 3% by weight of the monomer present, and drying the coated layer.

6. A process according to claim 5, wherein the temperatur range for the polymerisation reaction is from 60° to 70° C.

7. A process according to claim 5, wherein the amount of surfactant present during the polymerisation reaction is at least 12% by weight of the monomers present.

8. A process according to claim 7, wherein the amount of surfactant present during the polymerisation reaction is from 15 to 20% by weight of the monomers present.

9. A process according to claim 7, wherein the anionic surfactant is a sulphosuccinate compound.

10. A process according to claim 7, wherein the anionic surfactant is a sulphated or sulphonated polyethylene oxide compound.

11. A process according to claim 5, wherein the alkyl acrylate or alkyl methacrylate monomer is methyl acrylate, methyl methacrylate, butyl methacrylate, 2-ethylhexyl acrylate or butyl acrylate.

12. A process according to claim 5, wherein the ethylenically unsaturated copolymerisable acid is acrylic acid or methacrylic acid.

13. A process according to claim 5, wherein the ethylenically unsaturated comonomer is styrene, acrylonitril, vinylidene chloride, vinyl acetate, hydroxyethyl acrylate, hydroxyethyl methacrylate, hydroxypropyl methacrylate or butyl acrylate, optionally with a minor amount of methyl methacrylate.

14. A process according to claim 5, wherein the latex is partially cross-linked by a cross-linking agent.

15. A process according to claim 5, wherein the redox initiator system is a sodium or potassium persulphate/-sodium metabisulphite system.

* * * * *